US010865097B2

(12) United States Patent
Kraus et al.

(10) Patent No.: US 10,865,097 B2
(45) Date of Patent: Dec. 15, 2020

(54) CHEMICAL PRODUCT DISPENSING USING A FLUID DRIVE AND RETURN HOME INTERFACE

(71) Applicant: Ecolab USA Inc., St. Paul, MN (US)

(72) Inventors: Paul R. Kraus, Apple Valley, MN (US); Eric A. Dean, Sun Prairie, WI (US); Brock S. Mueggenborg, St. Paul, MN (US); Alissa R. Ellingson, Woodbury, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 16/453,582

(22) Filed: Jun. 26, 2019

(65) Prior Publication Data

US 2020/0002151 A1 Jan. 2, 2020

Related U.S. Application Data

(60) Provisional application No. 62/692,106, filed on Jun. 29, 2018.

(51) Int. Cl.
*F04B 43/02* (2006.01)
*B67D 7/74* (2010.01)
(Continued)

(52) U.S. Cl.
CPC ..... *B67D 7/741* (2013.01); *B67D 3/0058* (2013.01); *B67D 7/66* (2013.01); *B67D 7/74* (2013.01);
(Continued)

(58) Field of Classification Search
CPC .. F04C 14/28; F04B 43/0009; F04B 43/0081; F04B 43/02; F04B 49/02; B67D 7/66; B67D 7/74; B67D 7/741
See application file for complete search history.

(56) References Cited

U.S. PATENT DOCUMENTS 917,139 A 4/1909 Robison
3,101,090 A 8/1963 Carden
(Continued)

FOREIGN PATENT DOCUMENTS

CH 690669 A5 12/2000
CN 101484860 A 7/2009
(Continued)

OTHER PUBLICATIONS

"Quantex, Unique disposable liquid pump technology, Quantex pump applications," PDD Innovations Ltd., retrieved from http://quantex-arc.com/assets/uploads/files/PDD_Quantex-Applications_LoRes_1231251827.pdf on Dec. 8, 2014, 5 pp.
(Continued)

*Primary Examiner* — Kevin F Murphy
(74) *Attorney, Agent, or Firm* — Shumaker & Sieffert, P.A.

(57) ABSTRACT

A fluid-driven chemical product dispensing system dispenses fluid chemical product concentrates. The dispensing system includes a fluid drive unit powered by flow of a fluid, such as a diluent, and a pump which delivers the fluid chemical product concentrate from a supply to a destination. Upon exit from the fluid drive unit, the diluent is also delivered to the destination, where it mixes with the dispensed fluid chemical product concentrate to form a use solution. The dilution ratio of the volume of fluid chemical product concentrate dispensed per unit time versus the volume of diluent exiting the drive unit per unit time is constant over a defined range of diluent flow rates.

14 Claims, 9 Drawing Sheets

(51) Int. Cl.
*B67D 3/00* (2006.01)
*F04B 43/00* (2006.01)
*B67D 7/66* (2010.01)

(52) U.S. Cl.
CPC ..... *F04B 43/0081* (2013.01); *F04B 43/02* (2013.01); *B67D 3/0012* (2013.01); *B67D 2210/0012* (2013.01)

(56) References Cited

U.S. PATENT DOCUMENTS

| | | | | |
|---|---|---|---|---|
| 3,549,048 | A | 12/1970 | Goodman | |
| 4,358,252 | A * | 11/1982 | Hart | F04B 43/107 417/387 |
| 4,651,765 | A | 3/1987 | Beth | |
| 5,167,800 | A | 12/1992 | Ringer et al. | |
| 5,842,603 | A | 12/1998 | Schroeder | |
| 6,029,688 | A | 2/2000 | Kaufman | |
| 6,651,849 | B2 | 11/2003 | Schroeder et al. | |
| 7,674,100 | B2 | 3/2010 | Hayes-Pankhurst et al. | |
| 8,075,847 | B2 | 12/2011 | Zettlitzer et al. | |
| 8,342,364 | B2 | 1/2013 | Bertucci et al. | |
| RE44,841 | E | 4/2014 | Hayes-Pankhurst et al. | |
| 8,746,130 | B2 * | 6/2014 | Wackerle | F04B 45/047 92/103 M |
| 9,175,681 | B2 | 11/2015 | Hayes-Pankhurst et al. | |
| 9,581,157 | B2 | 2/2017 | Hayes-Pankhurst et al. | |
| 9,638,204 | B2 | 5/2017 | Hayes-Pankhurst et al. | |
| 9,725,297 | B2 | 8/2017 | Kraus et al. | |
| 10,392,242 | B2 | 8/2019 | Kraus et al. | |
| 2002/0017320 | A1 | 2/2002 | Walton et al. | |
| 2010/0108714 | A1 | 5/2010 | Bertucci et al. | |
| 2011/0024457 | A1 | 2/2011 | Somerfield | |
| 2013/0008522 | A1 | 1/2013 | Bertucci et al. | |
| 2013/0140323 | A1 | 6/2013 | Yun et al. | |
| 2016/0060095 | A1 * | 3/2016 | Kraus | B67D 7/74 222/144.5 |
| 2020/0002151 | A1 | 1/2020 | Kraus et al. | |

FOREIGN PATENT DOCUMENTS

| | | | |
|---|---|---|---|
| CN | 101663099 | A | 3/2010 |
| JP | 2001120488 | A | 5/2001 |
| JP | 2010537795 | A | 12/2010 |
| WO | 9636556 | A1 | 11/1996 |
| WO | 2006037354 | A1 | 4/2006 |
| WO | 2007109727 | A2 | 9/2007 |
| WO | 2008115203 | A1 | 9/2008 |
| WO | 2010025673 | A1 | 3/2010 |
| WO | 2016032832 | A1 | 3/2016 |

OTHER PUBLICATIONS

"Specifications of the Quantex Pump," Quantex Arc Ltd, retrieved from http://www.quantex-arc.com/pump-characteristics/specifications/ on Dec. 5, 2014, 9 pp. Includes Figures dated Aug. 15, 2012, May 5, 2013, Feb. 11, 2013, May 15, 2013, Sep. 30, 2013, and Jan. 1, 2014.

"Suma® Optifill, Dilution Control System for 3 Compartment Sinks," JohnsonDiversey, 2008, 1 pp. (Applicant points out that, in accordance with MPEP 609.04(a), the 2008 year of publication is sufficiently earlier than the effective U.S. filing date and any foreign priority date of Aug. 28, 2014 so that the particular month of publication is not in issue.).

International Search Report and Written Opinion of International Application No. PCT/US2019/039290, dated Nov. 4, 2019, 14 pp.

* cited by examiner

CHEMICAL PRODUCT DISPENSING USING A FLUID DRIVE AND RETURN HOME INTERFACE

This application claims the benefit of U.S. Provisional Application No. 62/692,106 filed Jun. 29, 2018, which is incorporated herein by reference in its entirety.

TECHNICAL FIELD

The disclosure relates to chemical product dispensing.

BACKGROUND

Chemical products are often packaged in a concentrated form that, depending upon the application, may be diluted with water to create a use solution having a desired concentration of the chemical product. These concentrates or ultra concentrates may permit more efficient transport and storage over their less concentrated counterparts. Such concentrated chemical products may include, for example, detergents and other cleaning, disinfecting, or sanitizing products. The chemical product concentrates may also be used in food processing, medical, or industrial applications. For cleaning applications, the concentration of the chemical product in the use solution may be important to ensure effective cleaning, disinfecting, and/or sanitizing. For example, there are many applications where the concentration of the use solution is regulated to ensure effective sanitizing or disinfecting.

SUMMARY

In general, this disclosure relates to metering and dispensing controlled quantities of a fluid product. The fluid product may include, for example, a fluid chemical product, a concentrated fluid chemical product, or an ultra-concentrated fluid chemical product.

In one example, the disclosure is directed to a dispensing system comprising a fluid drive unit including a housing having an inlet connected to receive a supply of a diluent such that flow of the diluent causes rotation of a rotor positioned within a cavity of the housing of the fluid drive unit, the housing further having an outlet from which the fluid exits the housing and is directed to a reservoir, wherein a rotational speed (revolutions per minute) of the rotor as a function of flow rate of the diluent is substantially linear over a defined range of diluent flow rates, a pump connected to receive a supply of a fluid chemical product concentrate, the pump further connected to be driven by the rotation of the fluid drive unit, resulting in dispensation of the fluid chemical product concentrate into the reservoir responsive to rotation of the fluid drive unit such that a dilution ratio of a volume of the fluid chemical product concentrate dispensed per unit time versus a volume of diluent exiting the fluid drive unit per unit time is constant over the defined range of diluent flow rates, and a return home interface having an off position and a dispense position, the return home interface comprising a lobe rotor configured to interface with the pump such that the pump is stopped at a desirable rotational index when the return home interface is in the off position.

In some examples, the diluent is a liquid or a gas. In some examples, the fluid drive unit comprises a turbine drive unit or a wheel drive unit. In some examples, the diluent is water. In some examples, the dilution ratio is in the range of 0.01 to 10 ounces per gallon.

In some examples, the rotor includes a drum having a plurality of blades disposed around a periphery of the drum, and wherein the blades have one of a flat shape, a scoop shape or a bucket shape. In some examples, a concentration of the fluid chemical product in a use solution formed in the reservoir is constant over the defined range of diluent flow rates. In some examples, the reservoir includes one of a container, a bucket, a pail, a bottle, a spray bottle, a sink, a sump, a non-rigid bag, a cleaning machine, a dish machine, or a laundry machine. In some examples, the fluid chemical product concentrate includes at least one of a detergent, a rinse agent, a bleach, a fruit and vegetable wash, a disinfectant, or a sanitizer. In some examples, the pump is a fixed volume displacement pump. In some examples, the pump is one of a rotary pump, a gear pump, a screw pump, a piston pump, or a peristaltic pump.

In some examples, the pump further includes a circular housing having a continuous interior sidewall, the circular housing further including an inlet through which the fluid chemical product is received and an outlet through which the fluid chemical product concentrate is dispensed, a pump lobe rotationally mounted within the circular housing, the lobe rotor including first and second opposed sides each forming a sealing surface with the interior sidewall, the lobe rotor further including third and fourth opposing sides each forming a cavity with the interior sidewall, and a flexible membrane having first and second ends each fixed to a different position on the interior sidewall and forming a sealing surface with the first or second opposed ends of the pump lobe as the pump lobe rotates within the housing.

In some examples, the lobe rotor of the return home interface is configured to interface with the pump such that the pump lobe is stopped at a rotational position within the housing in which the first and second ends are not in contact with the flexible membrane when the return home interface is in the off position.

In some examples, the lobe rotor of the return home interface is configured to interface with the pump such that the pump lobe freely rotates within the housing when the return home interface is in the dispense position.

The details of one or more examples are set forth in the accompanying drawings and the description below. Other features and advantages will be apparent from the description and drawings, and from the claims.

DETAILED DESCRIPTION

In general, this disclosure relates to a fluid-driven chemical product dispensing system for metering and dispensing of a fluid chemical product. The fluid chemical product may include a concentrated fluid chemical product or an ultra-concentrated fluid chemical product. The dispensing system is configured to be connected to a supply of the fluid chemical product. The dispensing system includes a drive unit powered by flow of a fluid, such as a diluent or a gas, and a pump which delivers the fluid chemical product concentrate from the supply to a destination for the dispensed fluid chemical product concentrate. The destination may include a receptacle, container, reservoir, bucket, pail, bottle, spray bottle, sink, sump, non-rigid bag, cleaning machine, dish machine, laundry machine, or any other intermediate or end use application. The dilution ratio of the volume of fluid chemical product concentrate dispensed per unit time versus the volume of diluent exiting the drive unit per unit time is constant over a defined range of diluent flow rates.

The fluid-driven chemical product dispensing system of the present disclosure may accurately dose chemistries that are challenging to accurately dispense due to inherent properties such as high viscosity liquid concentrate chemistries. Furthermore, the dispensing system does not require the use of electric power to provide accurate dispensing of such fluid chemical product concentrates. The system may also be used to dispense liquids in low temperature environments temperature (i.e., below 68° F.) in which the product viscosity increases to the extent that conventional aspirator-type dispensers are no-longer reliable dispensing methods.

The fluid-driven chemical product dispensing system may further optimize pump performance by providing a mechanism that prevents the pump rotor from stopping in an orientation that may result in prolonged deflection of components within the pump mechanism that can lead to poor pump performance.

In addition, the fluid-driven chemical product dispensing system enables consistent dispensing volumes of liquid chemistries, making it easier to ensure accurate dosing of product in a variety of environments over a wide temperature ranges, such as those experienced in cold food preparation or processing environments to hot/humid dishwashing or laundry areas. Another advantage is the ability to leverage the pressure of the in-house water supply to "power" the pump and yet achieve consistent dispensing.

Figure 1A:
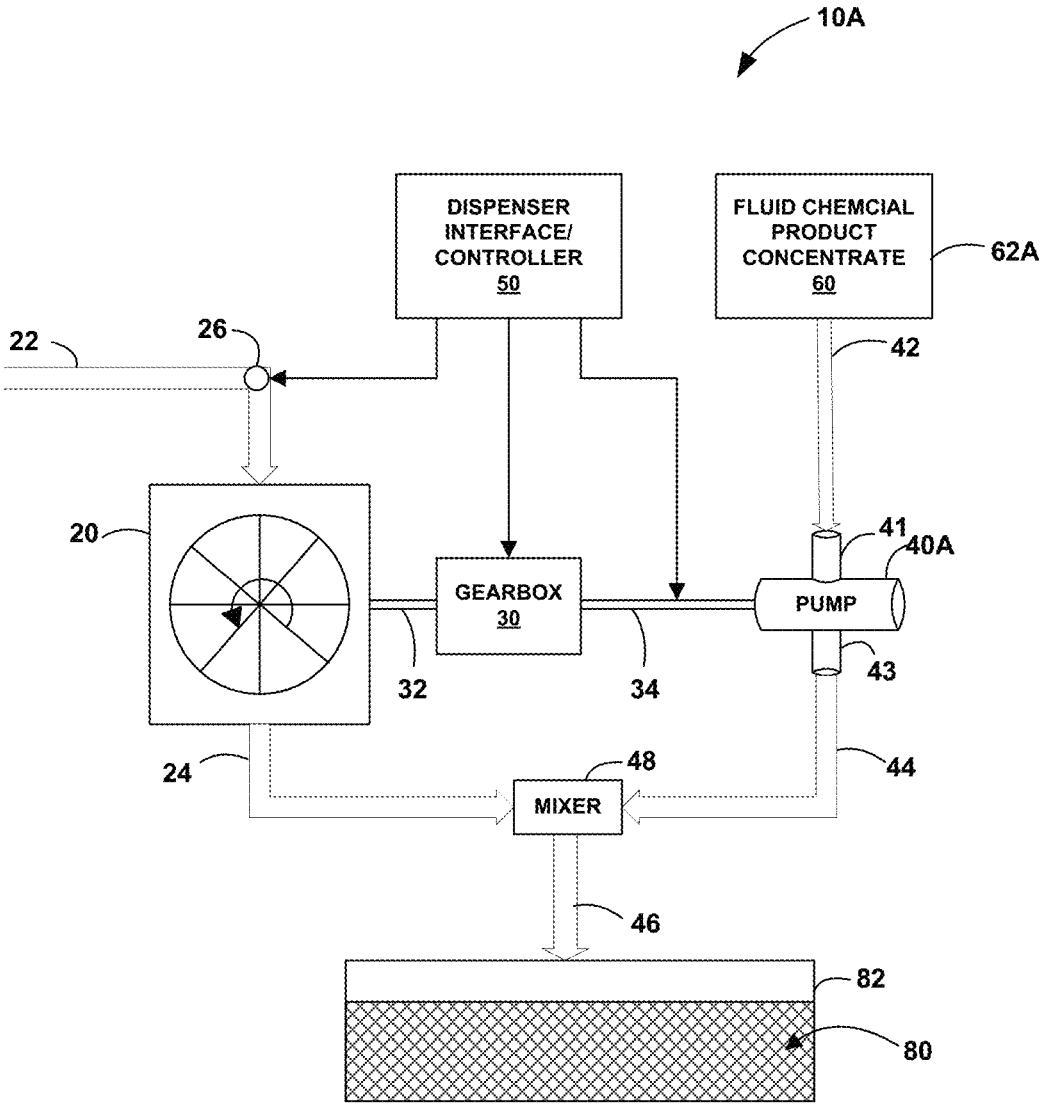
FIGS. 1A and 1B are schematic diagrams illustrating example fluid-driven chemical product dispensing systems in accordance with the present disclosure.
Figure 1B:
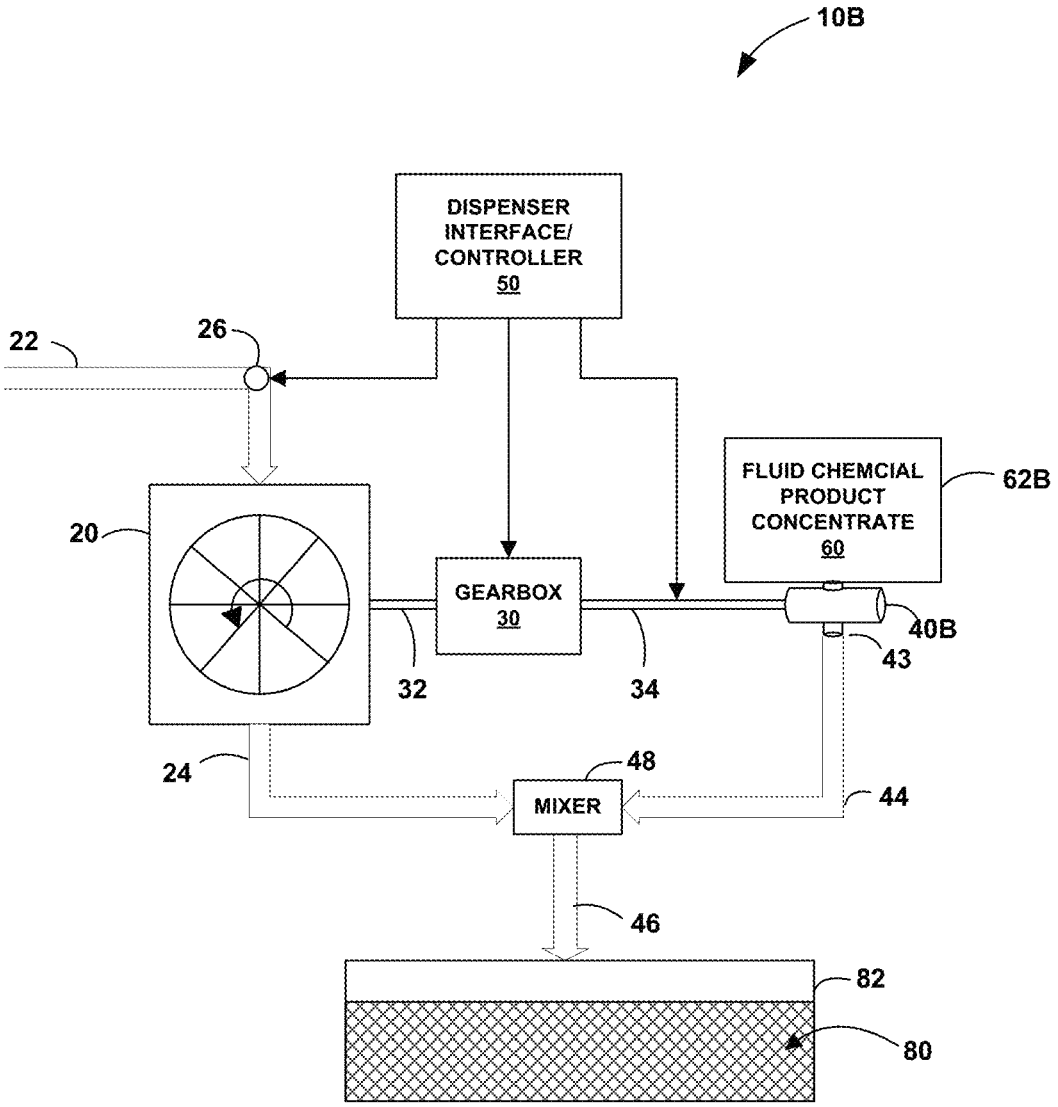

FIG. 1A is a diagram illustrating an example fluid-driven chemical product dispensing system 10A. FIG. 1B is a diagram illustrating another example fluid-driven chemical product dispensing system 10B. Both dispensing systems 10A and 10B include a drive unit 20 and an optional gearbox 30. In FIG. 1A, a supply of fluid chemical product concentrate 60 is stored in a product container 62A and connected through a feed line 42 to an inlet 41 of pump 40A. In FIG. 1B, a supply of fluid chemical product concentrate 60 is provided in a product container 62B having an integrated pump 40B. In some examples, the integrated product container 60B/pump 40B are disposable and designed for one-time-use. In such an example, the integrated product container 60B/pump 40B are removed and disposed of when the product container 60B is empty (or if a different chemical product is to be dispensed) and replaced with a replacement integrated product container 60B/pump 40B. In other examples, the integrated product container 60B/pump 40B may be refillable and designed for multiple uses.

In both FIGS. 1A and 1B, a first or input drive shaft 32 transfers rotational motion from the drive unit 20 to optional gearbox 30. A second or output drive shaft 34 transfers rotational motion from the gearbox to pump 40. Dispensing systems 10A and 10B may further include a dispenser interface 50 that may be actuated by a user to control dispensation of the fluid chemical product concentrate. Dispenser interface 50 may further include a return home interface that ensures the internal valve(s) or rotor(s) within the pump 40 are returned to the proper orientation each time the dispensing system is turned off.

Fluid chemical product concentrate 60 may include at least one of a detergent, a rinse agent, a bleach, a fruit and vegetable wash, a disinfectant, or a sanitizer. In addition to cleaning applications, the fluid chemical product concentrate may be one that is used for any other intermediate or end use application, including healthcare, food and/or beverage processing, or industrial applications. The fluid chemical product concentrate 60 may be contained in a product package from which it is to be dispensed or it may be poured into some other container or receptacle from which it is then dispensed. The product packages 62A and/or 62B may be any size or shape and may include a rigid container, a drum, a tank, a pouch, a bottle, a bag, a bag-in-box, a bag-in-bottle, or any other type of product package suitable for containing and dispensing fluid products.

In FIGS. 1A and 1B, pump 40 includes an inlet 41 (not visible in FIG. 1B due to integration into the product package) and an outlet 43. Inlet 41 is connected to receive the supply of fluid chemical product concentrate 60. In operation, pump 40 draws fluid chemical product concentrate 60 in through inlet 41, as indicated by arrow 42, and delivers the pumped fluid chemical product concentrate to product outlet 43 from which it is dispensed as indicated by arrow 44 and directed to an optional mixer 48. At the same time, diluent flowing through the drive unit 20 is directed through outlet 24 and to mixer 48, where it is combined with the fluid chemical product concentrate to form use solution 80, which is delivered to reservoir 82 via outlet 46. In another example, water and chemical product may be mixed after delivery to reservoir 82. In another example, water and chemical product may be mixed within outlet 43 of pump 40 and then delivered to reservoir 82.

Drive unit 20 includes an inlet 22 and an outlet 24. Drive unit 20 is powered by flow of a fluid through a fluid flow path defined by inlet 22, through the drive unit 20, and outlet 24. In some examples, the drive fluid may include a diluent, such as water or an aqueous solution. If flowing water is not available, drive unit 20 may be air powered. In the example of FIGS. 1A and 1B, drive unit 20 is directly connected to receive water from a source such as a municipal water supply system, sump, reservoir, or other water source. For example, drive unit 20 may be plumbed directly to the incoming water supply or otherwise directly connected to a water or fluid source. In other examples, use solution 80 from reservoir 82 may be pumped or otherwise delivered to inlet conduit 22 to power fluid drive unit 20.

Drive unit 20 includes a wheel drive unit that converts the energy from flow of the diluent or other drive fluid into a rotational form of power. In one example, fluid drive unit 20 includes a turbine drive unit. However, it shall be understood that fluid drive unit 20 may include other types of drive units, and that the disclosure is not limited in this respect. A water wheel, turbine, or other drive unit typically includes a rotor including a shaft or drum having a plurality of vanes or blades arranged around the periphery of the drum. The blades provide a driving surface for the flow of diluent. The blades may be flat, scooped, concave, bucket-shaped, or any other appropriate shape. The blades may further be perpendicular to the surface of the drum or may be angled with respect to the surface of the drum. In the case of a turbine drive unit, drive unit 20 includes a housing or casing surrounding the rotor which contains and directs the fluid diluent. The turbine may include an impulse turbine (such as a Pelton, a Turgo, a cross flow, or a water wheel), a tesla or bladeless turbine, a reaction turbine (such as a Francis, a propeller type or a screw type), or any other appropriate turbine type.

The energy provided by the flowing diluent turns the blades of drive unit 20 which is connected to transfer the rotational energy of the turning rotor to a first or input drive shaft 32. Drive unit 20 may be geared or include some other mechanism to adjust the dilution ratio of the chemical product concentrate dispensed; that is, the ratio of the volume of fluid chemical product concentrate dispensed per unit time to the volume of diluent exiting the drive unit per unit time. For example, a configurable gearbox 30 may be used to adjust (increase or decrease) the rotational speed (revolutions per minute or rpm) of an output drive shaft 34 from the relatively lower or higher rotational speed of input drive shaft 32. This effectively changes the rotational speed at which pump 40 is driven, thus changing the volume of fluid chemical product concentrate dispensed per unit time. Example dilution ratios may range from 0.01-10 ounces/gallon depending upon several factors including the concentration of chemical product concentrate, the viscosity of the chemical product concentrate, the desired concentration of the resulting use solution, etc.

Gearbox 30 may be implemented in a variety of ways such as one or more meshing gears, a chain drive, a belt and pulley drive, a continuously variable transmission, or other mechanism for adjusting (either increasing or decreasing) the rotational speed and torque from input drive shaft 32 to output drive shaft 34. An example pulley train may include one or more drive pulleys fixed at some location in the proximity of other driven pulleys and idle pulleys that allow for multiple "gearing ratio" [s] to be achieved with use of shafts and pulleys of varying diameter. An example continuously variable transmission may include two pulleys connected by a belt where one pulley is turned by the turbine and other is connected to the pump. Changing the size of the pulleys between small and large within the CVT changes the effective dilution.

One or both of the input drive shaft 32 and/or the output drive shaft 24 may be flexible to permit the pump and the supply of chemistry to be located remote from the drive unit.

In some examples, the dilution ratio (and thus the gear ratio provided by gearbox 30) may be selectable by a user to achieve the desired concentration of the fluid chemical product in the resulting use solution. In such a case, systems 10A and/or 10B may include one or more mechanical knobs or switches by which the user may select the desired dilution ratio. In other examples, selection of the gear ratio may be electronically controlled by input into a graphical user interface. In some examples, such dilution ration adjustments are accessible only to the authorized personnel, such as an installer, manager, or customer service representative, to prevent unauthorized tampering with the amount of product dispensed. This may reduce the likelihood for formation of use solutions having incorrect concentrations of the chemical product. In other examples, the gear ratio may be fixed to provide a known gear reduction between input drive shaft 32 and output drive shaft 34 and thus to provide a fixed dilution ratio.

Output drive shaft 34 transmits the rotational motion to pump 40. Pump 40 is thus ultimately driven by flow of the diluent through the drive unit 20. In the example of FIG. 1, both the diluent and the fluid chemical product concentrate are directed to reservoir 82 where they are combined to form a use solution 80. Alternatively, the diluent and the fluid chemical product may be directed to a mixer where they are combined before being delivered to the reservoir 82.

In the examples of FIGS. 1A and 1B, system 10A and 10B are closed systems in the sense that all the diluent delivered through the fluid flow path 22, 20, 24 is contained within the housing or casing of the fluid drive unit 20 and is thus captive and available to power the drive unit 20 until it is ultimately delivered to reservoir 82 or other end use destination. In this example system, the fluid chemical product concentrate and the diluent are dispensed in a constant proportion so that they form a use solution having a concentration of the fluid chemical product concentrate that is independent of the flow rate of the diluent over a flow rate range of interest. This may help to ensure a proper dilution ratio of the fluid chemical product concentrate; in other words, that the volume of fluid chemical product dispensed is in the correct proportion to the volume of diluent delivered to the end use application to maintain a desired concentration of the chemical product in the resulting use solution 80 over a range of diluent flow rates.

In the examples of FIGS. 1A and 1B, the use solution 80 is formed in a use solution reservoir 82. Reservoir may take any of several forms, and may include any one of a container, bucket, pail, bottle, spray bottle, sink, sump, non-rigid bag, cleaning machine, dish machine, laundry machine or may be directed to any other intermediate or end use application. Although in this example product outlet 44 and fluid outlet 24 are shown as separate components, in some examples product outlet 44 and fluid outlet 24 may merge or combine to form a single diluent/fluid product outlet from which the use solution 80 is dispensed. In another example, the diluent from drive unit 20 may be fed to pump 40 where it is mixed with the fluid chemical product concentrate within the pump outlet, and the resulting use solution is directed to the reservoir 82.

In use, when dispensation of the fluid chemical product concentrate 60 is desired, an operator may manually actuate dispenser interface 50 from a closed position to a dispense position by opening valve 26, thus starting the flow of diluent to inlet 22 of drive unit 20. Flow of fluid through drive unit 20 rotates first drive shaft 32, the rotation is reduced by the appropriate gear ratio by gearbox 30, and the resulting rotation of second drive shaft 34 is transferred to pump 40. Rotation of the pump mechanism 40 draws fluid chemical product concentrate 60 into the pump via pump inlet 41 as indicated by arrow 42 in FIG. 1A. The fluid chemical product concentrate is pumped to outlet 44 and directed to a mixer 48. At the same time, diluent flowing through the drive unit 20 is directed through outlet 24 and to mixer 48, where it is combined with the fluid chemical product concentrate to form use solution 80. As described above, water and chemical product may also be mixed after delivery to reservoir 82. In another example, water and chemical product may be mixed within outlet 43 of pump 40 and then delivered to reservoir 82.

In some examples, as discussed above, the volumetric flow rate of fluid chemical product concentrate dispensed by pump 40 is proportional to the volumetric flow rate of the diluent through drive unit 20 over a defined range of diluent flow rates. The dilution ratio (the ratio of the volumetric flow rate of the chemical product concentrate dispensed by the pump and the volumetric flow rate of the diluent dispensed) is thus substantially constant over the defined range of diluent flow rates. In this way, the dispensing systems 10A and/or 10B may maintain a dilution ratio that is substantially constant over a defined range of diluent flow rates. Dispensing systems 10A and/or 10B may therefore accurately dispense relatively small amounts of a fluid chemical product concentrate while maintaining a concentration of the end use solution within a desired range.

Pump 40 may be implemented using many different types of pumps. Considerations regarding the type of pump include, for example, the type of drive mechanism with which the pump is to be driven; the type of fluid chemical product concentrate to be dispensed; the concentration of the fluid chemical product to be dispensed; the pressure, viscosity and/or flow rate of the incoming drive fluid; the desired dispense flow rate (volume/time) of the chemical product to be dispensed; the desired relationship between the diluent flow rate and the dispensed chemical product flow rate; the type of product container; and/or any other factor that may affect the type of pump to be used.

In one example, the dilution ratio of the amount (volume) of fluid chemical product concentrate dispensed from pump 40 per unit time versus the amount (volume) of drive fluid dispensed from drive unit 20 per unit time is constant over a defined range of diluent flow rates. That is, the flow rate of the fluid chemical product concentrate dispensed versus the flow rate of the diluent exiting the fluid drive unit is constant. In this way, the amount of chemical product concentrate dispensed into the use solution reservoir 82 (as indicated by arrow 44) and the amount of drive fluid dispensed into use solution reservoir 82 (as indicated by arrow 24) will result in a use solution having a known, constant concentration over a flow rate range of interest, regardless of the pressure, or volume of fluid driving the drive unit 20.

For various cleaning, sanitizing or disinfecting applications, the dilution ratio for an example fluid chemical product concentrate may be in the range of 0.01-10 ounces/gallon and the flow rate of the diluent may be in the range of 1-4 gallons/minute.

In one example, pump 40 may be implemented using a fixed displacement rotary pump, in which the flow through the pump per rotation of the pump is fixed. That is, the volume of fluid output per rotation of the pump is a known constant volume. In another example, pump 40 may be a peristaltic pump, a rotary pump, or any pump that uses translation of rotary motion to move a fluid. In such an example, pump 40 includes a rotor with a number of "rollers" that compress a flexible tube containing the chemical product concentrate to be dispensed. As with the example of FIGS. 1A and 1B, the rotor is driven by drive unit. As the rotor turns, the part of the tube under compression is pinched closed thus forcing the chemical product concentrate to move through the tube.

In some examples, pump 40 may be implemented using a reciprocating or rotary positive displacement pump, such as a gear pump, a screw pump, a piston pump, a peristaltic pump, etc. As another example, pump 40 may be implemented using a velocity pump, such as a centrifugal pump, a radial flow pump, an axial flow pump, etc. Pump 40 may also be implemented using a gravity pump, or any other type of pump known to those of skill in the art. The displacement may be fixed or variable. In some applications, the pump may be a single-use pump or a disposable pump. It shall therefore be understood that any type of pump capable of delivering fluids may be used, and that the disclosure is not limited in this respect.

Figure 2A:
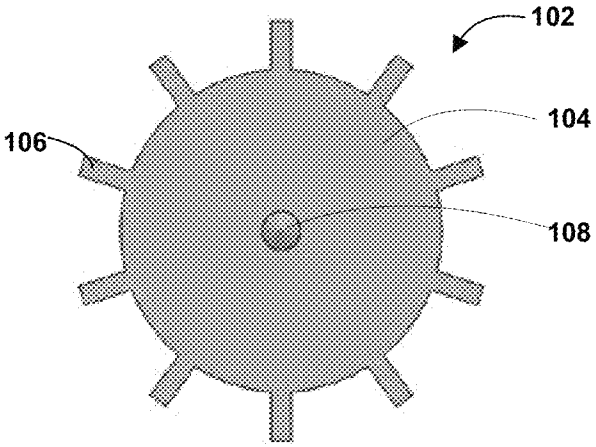
FIGS. 2A-2C are example rotors for a fluid-driven chemical product dispensing system.
Figure 2C:
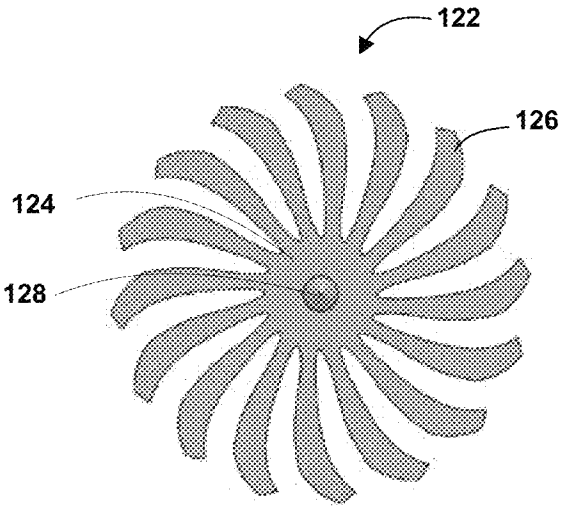
Figure 2B:
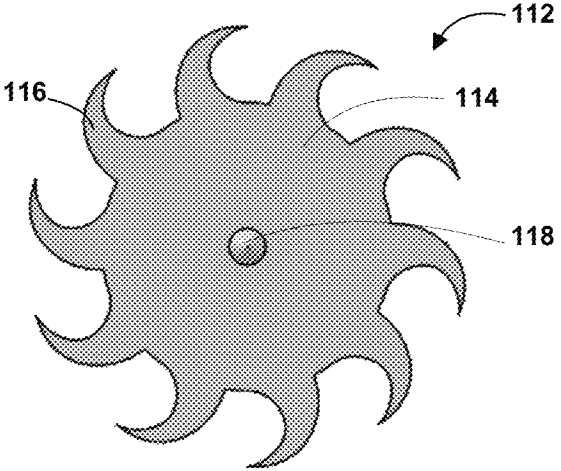

FIGS. 2A-2C show example rotor shapes for a fluid drive unit such as fluid drive unit 20 in the fluid-driven chemical product dispensing system of FIG. 1. FIG. 2A is an example rotor 102 having a drum 104 with a plurality of flat blades 106 disposed around the periphery of drum 104, and that rotates around a central axis 108. FIG. 2B is an example rotor 112 having a drum 114 and a plurality of scoop- or bucket-shaped blades 116 disposed around the periphery of drum 114, and that rotates around a central axis 118. FIG. 2C is another example rotor 122 having a drum 124 and a plurality of scoop- or bucket-shaped blades 126 disposed around the periphery of drum 124, and that rotates around a central axis 128. Rotor 122 includes relatively more blades 126 than rotor 112 and has a relatively smaller diameter drum 124 as compared to drum 114 of rotor 112.

Figure 3:
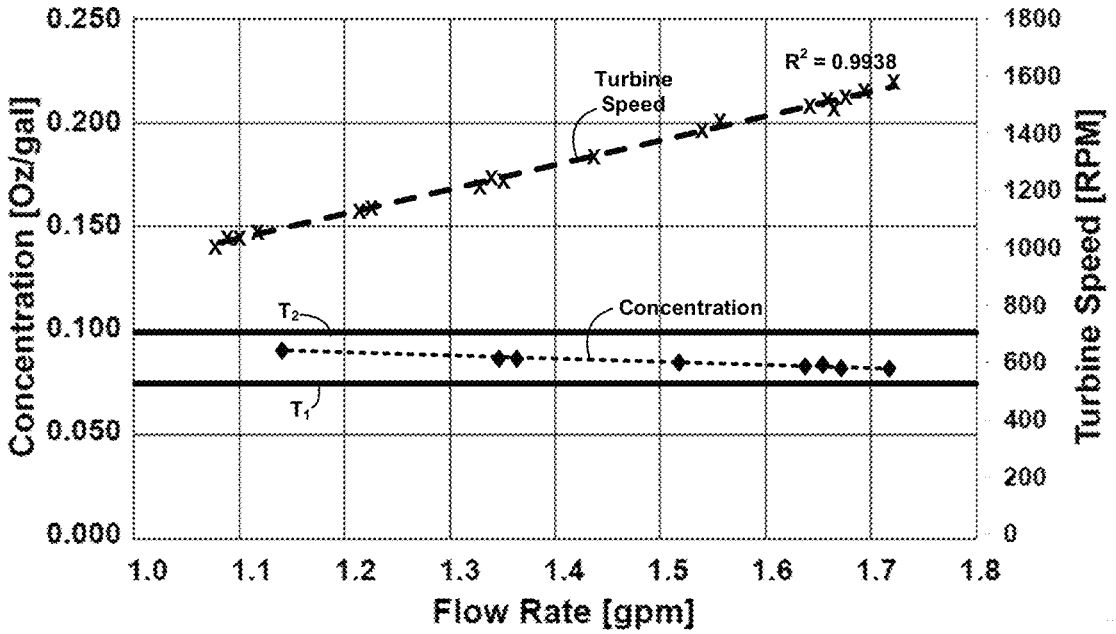
FIG. 3 is a graph showing turbine speed (revolutions per minute) as a function of flow rate and concentration of a use solution as a function of diluent flow rate for a fluid chemical product concentrate.

FIG. 3 is a graph showing turbine speed (rpm) as a function of flow rate for the example rotor 112 shown in FIG. 2B. FIG. 3 also shows concentration of a use solution as a function of diluent flow rate for a fluid chemical product concentrate dispensed using a drive unit having a rotor design such as rotor 112 shown in FIG. 2B. The lower boundary of the target concentration range is given by $T_1$ (approximately 0.075 oz/gal in this example) and the upper boundary of the target concentration range is given by $T_2$ (approximately 0.100 oz/gal in this example). As can be seen in FIG. 3, the turbine speed as a function of flow rate was substantially linear ($R^2$=0.9938) in the flow rate range of interest (approximately 1 gallon/minute to 1.8 gallons per minute). The resulting concentration of the chemical product concentrates is substantially constant across the flow rates of interest; that is, the resulting concentration remained within the target range $T_1 \leq \text{Concentration} \leq T_2$ across the flow rate range of interest.

Figure 4A:
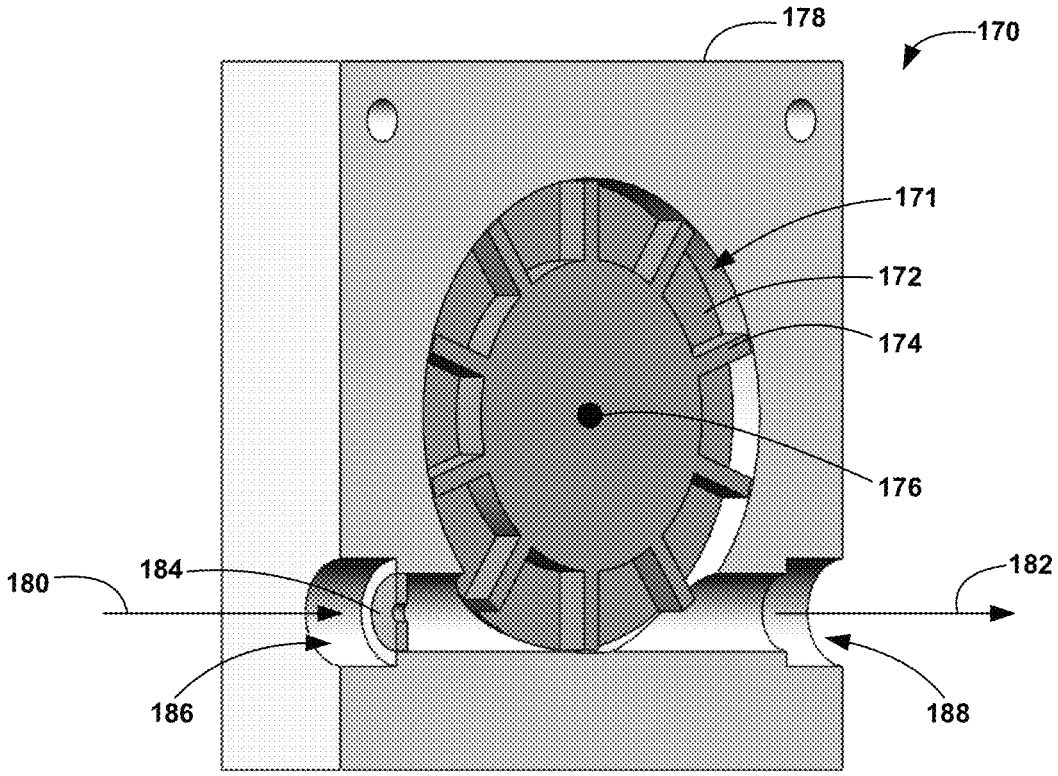
FIG. 4A shows a perspective view of an example fluid drive unit and FIG. 4B shows a top view of an example rotor for the fluid drive unit of FIG. 4B.

FIG. 4A shows a perspective view of an example impulse-type turbine drive unit 170. Drive unit 170 includes a housing 170 having a cavity 171 that encloses a rotor 172. Rotor 172 is rotatable around a central axis 176 and includes a drum 173 having a plurality of blades 174 disposed around the periphery of the drum. The configuration of the rotor and the blades (including the number of blades) is shown generically in this example for purposes of illustration, and it shall be understood that other rotor/blade (such as scoop- or bucket-shaped) configurations may also be used. Housing 178 further includes a fluid inlet 186 having a reduced nozzle orifice 184 and a fluid outlet 188. The reduced size of nozzle orifice 184 increases the velocity of the incoming diluent, thus directing a more forceful, higher-speed jet of diluent against blades 174 of the rotor 172.

Figure 4B:
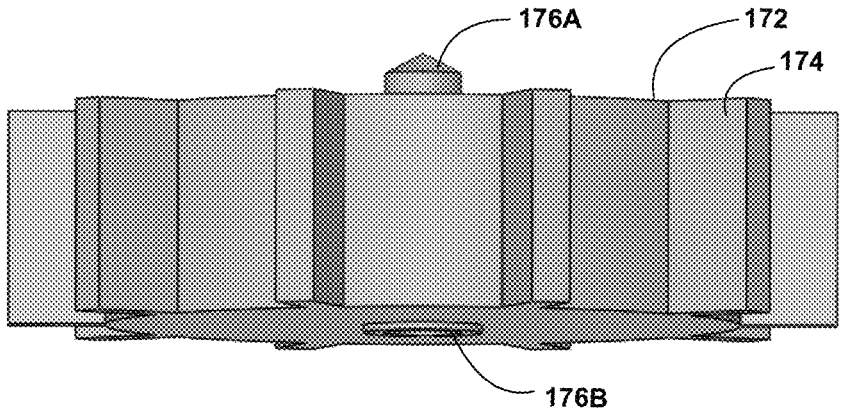

FIG. 4B shows a top view of the example rotor 172, and in which an axle 176 includes a first end having a spindle 176A sized to prevent contact between the front face of rotor 172 and interior surfaces of cavity 171, and a second end 176B having a spacer sized to prevent contact between the back face of rotor 172 and housing 170. The spacing provided by axle 176 thus reduce friction between the rotor and the interior surfaces of the cavity 171.

FIG. 5A-5D show an example return home interface 200 for a fluid-driven chemical product dispensing system in accordance with the present disclosure. Return home interface 200 may be used to implement dispenser interface 50 of FIGS. 1A and/or 1B. Return home interface 200 includes a push knob 202, a crank link 204, a slider 206, a pushing link 208 and a lobe rotor 210. The purpose of return home interface 200 is to help ensure the internal valve(s) or rotor(s) within the pump are returned to the proper orientation, or "index", at the end of each dispense cycle. This helps to minimize deflection of elastomeric membranes within the pump, thus preventing prolonged deflection of flexible membranes within the pump mechanism that can occur if certain internal pump components are stopped at an undesirable pump index. Such prolonged deflection may lead to degradation or permanent stretching of the membranes, which may in turn lead to poor pump performance.

Push knob 202 of return home interface 200 is the point of interface for a user and is the mechanism by which a user may initiate and/or stop a dispense cycle. In this example, to start a dispensing cycle, the user manually pushes in push knob 202 and rotates it to the right. The rotation to the right locks the dispenser (such as dispensing system 10) into dispensing mode until the user rotates it back to the left. Crank link 204 transfers the rotational motion from push knob to slider 206, which is fixedly mounted to pushing link 208. Slider 206 transfers motion from crank link 204 to pushing link 208, which in turn transfers motion from slider 206 to lobe rotor 210. Lobe rotor 210 is connected to the pump (such as pump 40 of FIG. 1) and transfers motion from pushing link 208 to the pump. When the push knob 202 is in the full right or dispense position as shown in FIG. 5B, the pushing link 208 is free of lobe rotor 210, thus permitting the pump to dispense fluid chemical product concentrate.

Figure 5A:
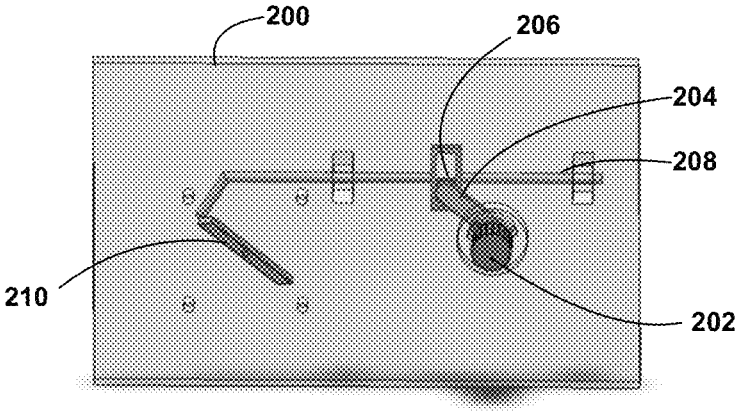
FIGS. 5A-5D show an example return home interface for a fluid-driven chemical product dispensing system in accordance with the present disclosure.
Figure 5B:
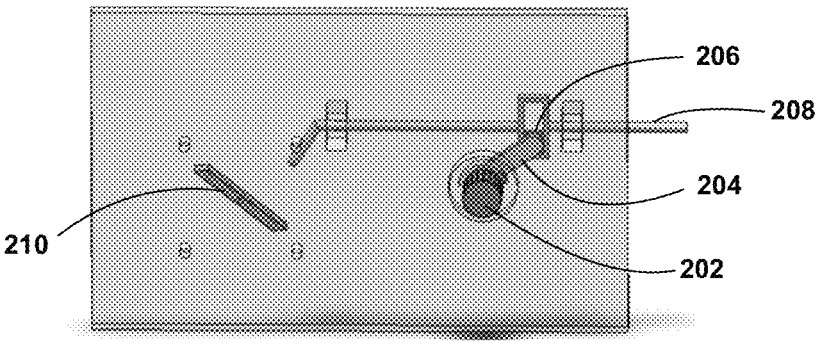
Figure 5C:
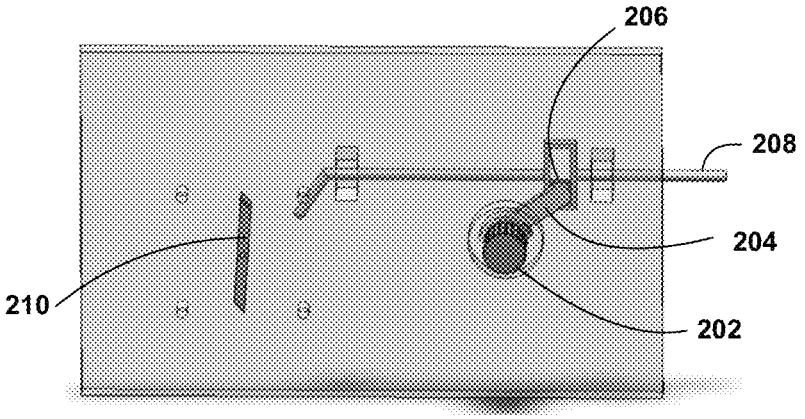
Figure 5D:
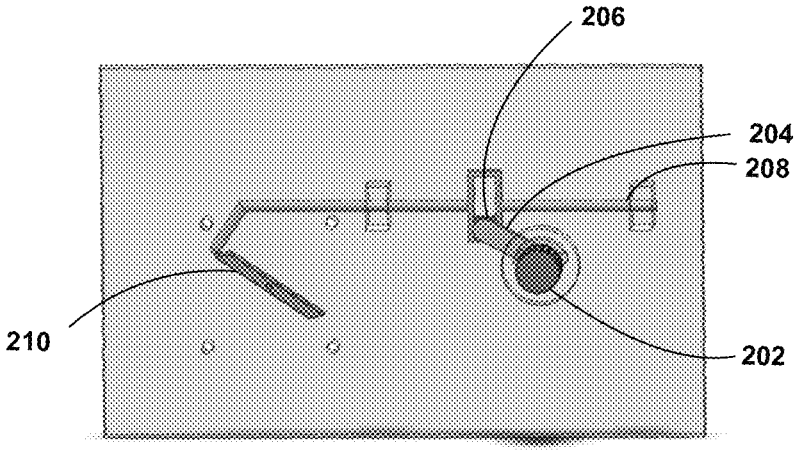

At the beginning of a dispense cycle, the push knob is in the normal or dwell state (dispenser off or closed) position shown in FIG. 5A. When the user initiates a dispense cycle by rotating push knob 202 to the right and into the dispense position (FIG. 5B), pushing link 208 is free of lobe rotor 210, thus permitting the pump to dispense fluid chemical product concentrate. In FIG. 5C, the flow of diluent through the fluid drive unit (not shown) has stopped, and the pump is no longer being driven to dispense chemical product concentrate. This may result in lobe rotor 210 stopped at an undesired index with respect to the pump as further described below. As shown in FIG. 5D, when the user turns off the dispense cycle by rotating push knob to the full left (dispenser off or closed) position, lobe rotor 210 engages the pump to move the internal pump rotor to a position in which the elastomeric membranes inside the pump are subjected to the least amount of deflection.

Figure 6A:
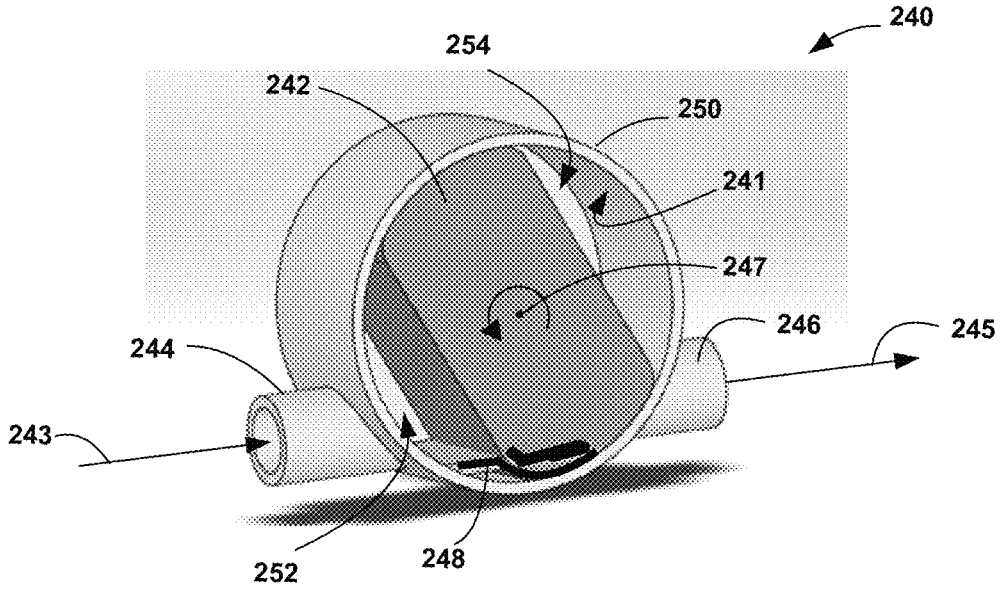
FIGS. 6A-6B show a front and back perspective views, respectively, of an example pump.
Figure 6B:
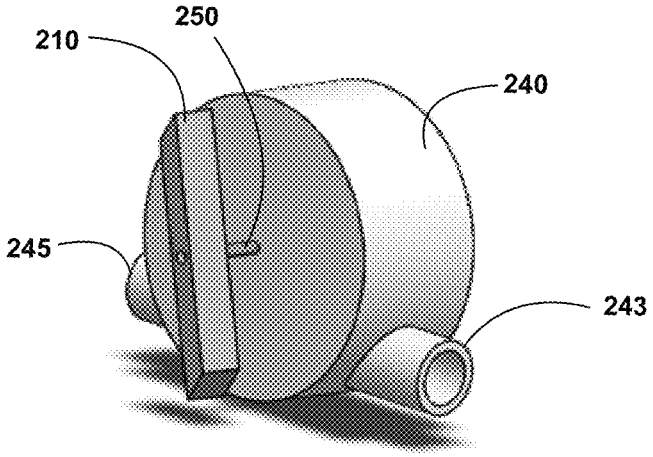

FIGS. 6A-6B show a front and back perspective views, respectively, of an example pump 240 of a type that may be used with the present disclosure. In this example, pump 240 is a type of fixed displacement rotary pump; however, it shall be understood that pump 240 may be any one of a rotary pump, a gear pump, a screw pump, a piston pump, a peristaltic pump, or other type of pump. Pump includes a housing 249 having an interior surface 241, a rotational pump lobe 242, a flexible membrane 248, and a pump drive shaft 250. The pump housing further includes apertures forming an inlet 244 and an outlet 246. Pump drive shaft 250 interfaces with lobe rotor 210 of return home interface, such as example return home interface 200 as shown in FIGS. 5A-5D. In use, pump drive shaft rotates pump lobe 242 around an axis 247 as indicated in FIG. 6A. Pump lobe 242 is shaped such that first and second opposed ends are sized to fit within interior sidewall 241 of housing 250 and having third and fourth opposed ends that form first and second cavities 252 and 254, respectively, with interior sidewall 241. The first and second opposed ends of pump lobe 242 are sized to form a seal between the housing sidewall 241 such that no chemical product can travel between the housing sidewall 241 and pump lobe 242 and thus there can be no flow or chemical product between first and second cavities 252 and 254. As pump lobe 242 rotates, one of first or second ends comes in contact with flexible membrane 248. Membrane 248 is deformed as indicated in FIG. 6A as pump lobe 242 rotates around axis 247. Movement of pump lobe 242 creates first cavity 252, thus drawing in fluid chemical product concentrate through inlet 242 as indicated by arrow 243. At the same time, rotation of pump lobe 242 pushes any fluid chemical product concentrate in second cavity 242 out of outlet 246 as indicated by arrow 245. Continuous rotation of pump lobe 242 thus results in a continuous dispensation of the fluid chemical product from inlet 244 to outlet 245.

Figure 7A:
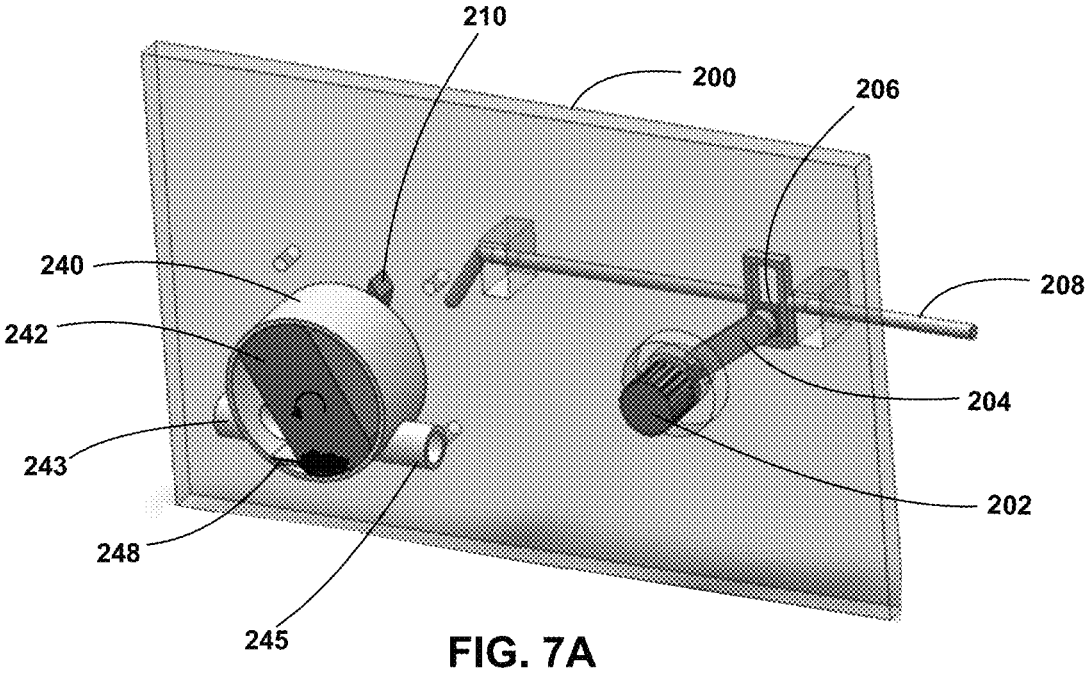
FIGS. 7A and 7B show an example return home interface and an example pump in the dispense and closed positions, respectively.
Figure 7B:
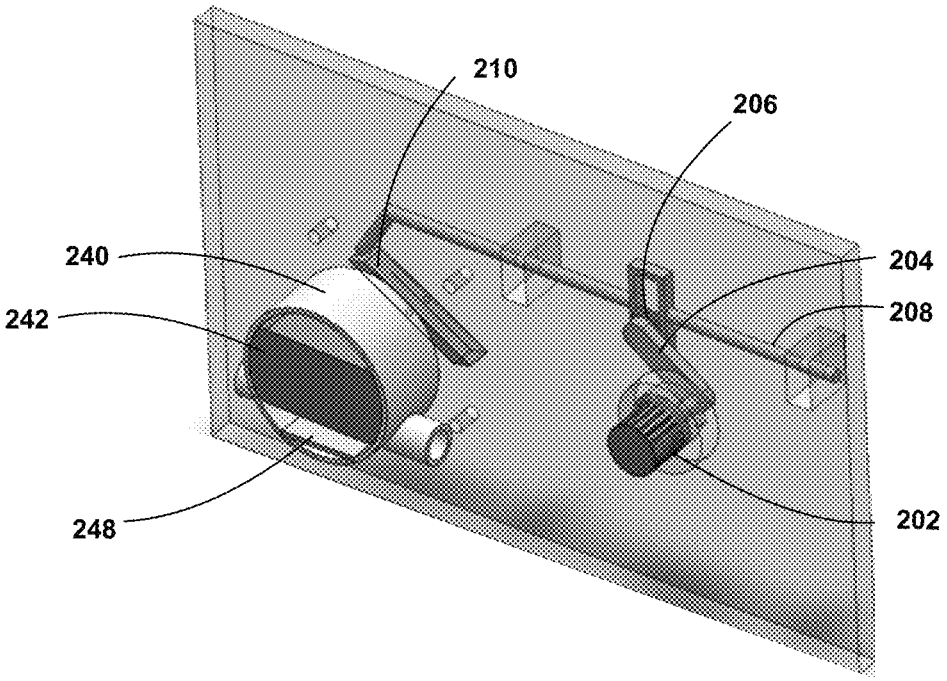

FIGS. 7A and 7B show an example return home interface 200 and an example pump 240 in the dispense and closed positions, respectively. As discussed above, the purpose of return home interface 200 is to help ensure that pump lobe 242 is returned to a proper orientation, or "index", at the end of each dispense cycle. This helps to minimize deflection of flexible membrane 248 within the pump, thus preventing prolonged deflection of flexible membranes within the pump mechanism that can occur if certain internal pump components, such as pump lobe 242 in this example, are stopped at an undesirable pump index. Such prolonged deflection may lead to degradation or permanent stretching of the membranes, which may in turn lead to poor pump performance.

For example, in FIG. 7A, the dispensing system is in the dispense position, and pump lobe 242 freely rotates within pump housing 250 (assuming it is being driven by the drive unit as described above). Once the flow of diluent through the drive unit stops, pump lobe 242 will stop rotating and pumping fluid chemical product through the pump 240. If the pump lobe 242 is stopped at the position shown in FIG. 7A, flexible membrane 248 will be stopped in a deformed position for an unknown period of time, possibly resulting in degradation of the membrane and decreased pump output. Movement of the return home interface to the closed or off position, as shown in FIG. 7B, causes lobe rotor 210 to rotate pump lobe 242 to a position in which the membrane is not flexed or deformed, thus reducing the likelihood of a decrease pump performance over time due to deformation of the pump when the dispenser is in the closed or off position. In addition, the pump lobe 242 may be stopped at a position in which the pump inlet 243 and outlet 245 are closed, thus reducing the likelihood of leakage of chemical product from the pump when the pump is in the off or closed position.

To help ensure that lobe rotor 210 rotates pump lobe 242 to an acceptable rotational position (or index) within the pump housing 250, lobe rotor 210 may be keyed to interface with pump 240 in a known orientation such that when pump 240 is connected to return home interface 200, pump lobe 242 is in the desired closed rotational position with respect to lobe rotor 210 when return home mechanism is in the closed or off position (as shown in FIG. 7B).

In some examples, return home mechanism is at least a part of dispenser interface 50 of FIGS. 1A and 1B. In addition to allowing pump 240 to freely rotate (and thus dispense fluid chemical product) actuation of return home mechanism may also turn on the water or diluent supply for drive unit 20. In this way, a single actuator may simultaneously turn on the drive water supply and dispense the chemical product, thus creating the resulting use solution 80. In other examples, dispenser interface 50 may be configured such that a separate actuation is required to turn on the valve 26 for the water supply 22 and to turn pump 40 to a dispense position.

In some examples, dispenser interface 50 of FIGS. 1A and 1B may include an automated dispenser controller that automatically monitors conditions of the use solution 80 in reservoir 82 and initiates and controls dispensation of the fluid chemical product. The automated controller 50 in such examples would include one or more processors that receive information from one or more sensors monitoring various properties or parameters of the use solution (such as concentration of one or more active ingredients, pH, temperature, conductivity, turbidity, etc.). The automated controller analyzes the sensed parameters to determine if, when, and how much additional fluid chemical product concentrate should be added to the use solution to maintain the use solution within a target range. If controller 50 determines additional fluid chemical product should be added, the controller may automatically actuate valve 26, thus starting the flow of diluent to inlet 22 of drive unit 20. Flow of fluid through drive unit 20 rotates first drive shaft 32, the rotation is reduced by the appropriate gear ratio by gearbox 30, and the resulting rotation of second drive shaft 34 is transferred to pump 40. Rotation of the pump mechanism 40 draws fluid chemical product concentrate 60 into the pump via pump inlet 41 as indicated by arrow 42 in FIG. 1A (or similarly in FIG. 1B). The fluid chemical product concentrate is pumped to outlet 44 and directed to a mixer 48. At the same time, diluent flowing through the drive unit 20 is directed through outlet 24 and to mixer 48, where it is combined with the fluid chemical product concentrate to form use solution 80. As described above, water and chemical product may also be mixed after delivery to reservoir 82. In another example, water and chemical product may be mixed within outlet 43 of pump 40 and then delivered to reservoir 82.

When an appropriate amount of chemical product has been dispensed, controller 50 may automatically close valve 26, stopping the flow of diluent through the drive unit 20 and stopping dispensation of chemical product through pump 40A. In addition, controller 50 may electronically control a return to home mechanism (such as return to home mechanism 200) to return pump rotor 242 to a home position, such as shown in FIG. 7B.

EXAMPLES

Example 1

A dispensing system comprising a fluid drive unit including a housing having an inlet connected to receive a supply of a diluent such that flow of the diluent causes rotation of a rotor positioned within a cavity of the housing of the fluid drive unit, the housing further having an outlet from which the fluid exits the housing and is directed to a reservoir, wherein a rotational speed (revolutions per minute) of the rotor as a function of flow rate of the diluent is substantially linear over a defined range of diluent flow rates, a pump connected to receive a supply of a fluid chemical product concentrate, the pump further connected to be driven by the rotation of the fluid drive unit, resulting in dispensation of the fluid chemical product concentrate into the reservoir responsive to rotation of the fluid drive unit such that a dilution ratio of a volume of the fluid chemical product concentrate dispensed per unit time versus a volume of diluent exiting the fluid drive unit per unit time is constant over the defined range of diluent flow rates, and a return home interface having an off position and a dispense position, the return home interface comprising a lobe rotor configured to interface with the pump such that the pump is stopped at a desirable rotational index when the return home interface is in the off position.

Example 2

The dispensing system of Example 1 wherein the diluent is a liquid or a gas.

Example 3

The dispensing system of Example 1 wherein the fluid drive unit comprises a turbine drive unit or a wheel drive unit.

Example 4

The dispensing system of Example 1 wherein the diluent is water.

Example 5

The dispensing system of Example 1 wherein the dilution ratio is in the range of 0.01 to 10 ounces per gallon.]

Example 6

The dispensing system of Example 1 wherein the rotor includes a drum having a plurality of blades disposed around a periphery of the drum, and wherein the blades have one of a flat shape, a scoop shape or a bucket shape.

Example 7

The dispensing system of Example 1 wherein a concentration of the fluid chemical product in a use solution formed in the reservoir is constant over the defined range of diluent flow rates.

Example 8

The dispensing system of Example 1 wherein the reservoir includes one of a container, a bucket, a pail, a bottle, a spray bottle, a sink, a sump, a non-rigid bag, a cleaning machine, a dish machine, or a laundry machine.

Example 9

The dispensing system of Example 1 wherein the fluid chemical product concentrate includes at least one of a detergent, a rinse agent, a bleach, a fruit and vegetable wash, a disinfectant, or a sanitizer.

Example 10

The dispensing system of Example 1 wherein the pump is a fixed volume displacement pump.

Example 11

The dispensing system of Example 1 wherein the pump is one of a rotary pump, a gear pump, a screw pump, a piston pump, or a peristaltic pump.

Example 12

The dispensing system of Example 1 wherein the pump further includes a circular housing having a continuous interior sidewall, the circular housing further including an inlet through which the fluid chemical product is received and an outlet through which the fluid chemical product concentrate is dispensed, a pump lobe rotationally mounted within the circular housing, the lobe rotor including first and second opposed sides each forming a sealing surface with the interior sidewall, the lobe rotor further including third and fourth opposing sides each forming a cavity with the interior sidewall, and a flexible membrane having first and second ends each fixed to a different position on the interior sidewall and forming a sealing surface with the first or second opposed ends of the pump lobe as the pump lobe rotates within the housing.

Example 13

The dispensing system of Example 12 wherein the lobe rotor of the return home interface is configured to interface with the pump such that the pump lobe is stopped at a rotational position within the housing in which the first and second ends are not in contact with the flexible membrane when the return home interface is in the off position.

Example 14

The dispensing system of Example 12 wherein the lobe rotor of the return home interface is configured to interface with the pump such that the pump lobe freely rotates within the housing when the return home interface is in the dispense position.

Various examples have been described. These and other examples are within the scope of the following claims.

The invention claimed is:

1. A dispensing system comprising:

a fluid drive unit including a housing having an inlet connected to receive a supply of a diluent such that flow of the diluent causes rotation of a rotor positioned within a cavity of the housing of the fluid drive unit, the housing further having an outlet from which the fluid exits the housing and is directed to a reservoir, wherein a rotational speed (revolutions per minute) of the rotor as a function of flow rate of the diluent is substantially linear over a defined range of diluent flow rates;

a pump connected to receive a supply of a fluid chemical product concentrate, the pump further connected to be driven by the rotation of the fluid drive unit, resulting in dispensation of the fluid chemical product concentrate into the reservoir responsive to rotation of the fluid drive unit such that a dilution ratio of a volume of the fluid chemical product concentrate dispensed per unit time versus a volume of diluent exiting the fluid drive unit per unit time is constant over the defined range of diluent flow rates; and a return home interface having an off position and a dispense position, the return home interface comprising:

a lobe rotor configured to interface with the pump such that the pump is stopped at a desirable rotational index when the return home interface is in the off position.

2. The dispensing system of claim 1 wherein the diluent is a liquid or a gas.

3. The dispensing system of claim 1 wherein the fluid drive unit comprises a turbine drive unit or a wheel drive unit.

4. The dispensing system of claim 1 wherein the diluent is water.

5. The dispensing system of claim 1 wherein the dilution ratio is in the range of 0.01 to 10 ounces per gallon.

6. The dispensing system of claim 1 wherein the rotor includes a drum having a plurality of blades disposed around a periphery of the drum, and wherein the blades have one of a flat shape, a scoop shape or a bucket shape.

7. The dispensing system of claim 1 wherein a concentration of the fluid chemical product in a use solution formed in the reservoir is constant over the defined range of diluent flow rates.

8. The dispensing system of claim 1 wherein the reservoir includes one of a container, a bucket, a pail, a bottle, a spray bottle, a sink, a sump, a non-rigid bag, a cleaning machine, a dish machine, or a laundry machine.

9. The dispensing system of claim 1 wherein the fluid chemical product concentrate includes at least one of a detergent, a rinse agent, a bleach, a fruit and vegetable wash, a disinfectant, or a sanitizer.

10. The dispensing system of claim 1 wherein the pump is a fixed volume displacement pump.

11. The dispensing system of claim 1 wherein the pump is one of a rotary pump, a gear pump, a screw pump, a piston pump, or a peristaltic pump.

12. The dispensing system of claim 1 wherein the pump further includes:

a circular housing having a continuous interior sidewall, the circular housing further including an inlet through which the fluid chemical product is received and an outlet through which the fluid chemical product concentrate is dispensed;

a pump lobe rotationally mounted within the circular housing, the lobe rotor including first and second opposed sides each forming a sealing surface with the interior sidewall, the lobe rotor further including third and fourth opposing sides each forming a cavity with the interior sidewall;

a flexible membrane having first and second ends each fixed to a different position on the interior sidewall and forming a sealing surface with the first or second opposed ends of the pump lobe as the pump lobe rotates within the housing.

13. The dispensing system of claim 12 wherein the lobe rotor of the return home interface is configured to interface with the pump such that the pump lobe is stopped at a rotational position within the housing in which the first and second ends are not in contact with the flexible membrane when the return home interface is in the off position.

14. The dispensing system of claim 12 wherein the lobe rotor of the return home interface is configured to interface with the pump such that the pump lobe freely rotates within the housing when the return home interface is in the dispense position.

* * * * *